US008215446B2

(12) United States Patent
Pompei

(10) Patent No.: US 8,215,446 B2
(45) Date of Patent: Jul. 10, 2012

(54) SOUND FIELD CONTROLLER

(76) Inventor: F. Joseph Pompei, Wayland, MA (US)

( * ) Notice: Subject to any disclaimer, the term of this patent is extended or adjusted under 35 U.S.C. 154(b) by 0 days.

(21) Appl. No.: 12/823,270

(22) Filed: Jun. 25, 2010

(65) Prior Publication Data

US 2011/0017545 A1 Jan. 27, 2011

Related U.S. Application Data

(63) Continuation of application No. PCT/US2008/014050, filed on Dec. 24, 2008.

(60) Provisional application No. 61/026,355, filed on Feb. 5, 2008, provisional application No. 61/025,183, filed on Jan. 31, 2008, provisional application No. 61/009,495, filed on Dec. 28, 2007.

(51) Int. Cl.

| | |
|---|---|
| ***F01N 1/06*** | (2006.01) |
| ***G10K 11/175*** | (2006.01) |
| *F01N 1/00* | (2006.01) |
| *G10K 11/16* | (2006.01) |

(52) U.S. Cl. ..... 181/206; 181/296; 381/71.2; 381/71.14

(58) Field of Classification Search ..... 181/296, 181/206; 381/71.2, 71.4, 71.7, 71.13, 71.14, 381/71.1, 71.8, 77

See application file for complete search history.

(56) References Cited

U.S. PATENT DOCUMENTS

| | | | | |
|---|---|---|---|---|
| 4,985,925 | A * | 1/1991 | Langberg et al. | 381/71.6 |
| 6,016,351 | A | 1/2000 | Raida et al. | |
| 6,661,285 | B1 * | 12/2003 | Pompei et al. | 330/251 |
| 6,771,785 | B2 * | 8/2004 | Pompei | 381/191 |
| 6,775,388 | B1 * | 8/2004 | Pompei | 381/191 |
| 6,914,991 | B1 * | 7/2005 | Pompei | 381/111 |
| 7,062,050 | B1 * | 6/2006 | Pompei | 381/77 |
| 7,106,180 | B1 * | 9/2006 | Pompei | 340/384.7 |
| 7,391,872 | B2 * | 6/2008 | Pompei | 381/111 |
| 2002/0172374 | A1 * | 11/2002 | Bizjak | 381/71.14 |
| 2003/0039173 | A1 * | 2/2003 | Yurchenko et al. | 367/903 |
| 2003/0185405 | A1 * | 10/2003 | Spencer et al. | 381/77 |
| 2004/0234080 | A1 * | 11/2004 | Hernandez et al. | 381/71.11 |
| 2005/0195985 | A1 * | 9/2005 | Croft et al. | 381/77 |
| 2005/0248346 | A1 * | 11/2005 | Sellers | 324/318 |
| 2005/0281413 | A1 * | 12/2005 | Croft, III | 381/77 |
| 2007/0170984 | A1 * | 7/2007 | Andersen et al. | 330/10 |
| 2008/0063214 | A1 * | 3/2008 | Spencer et al. | 381/77 |

FOREIGN PATENT DOCUMENTS

| | | | |
|---|---|---|---|
| DE | 196 28 849 | A1 | 1/1998 |
| GB | 1 147 103 | A | 4/1969 |
| WO | WO 2009/085287 | A1 | 7/2009 |

OTHER PUBLICATIONS

International Search Report and Written Opinion of the International Searching Authority, for Application No. PCT/US2008/014050, 15 pages, dated Apr. 7, 2009.

International Preliminary Report on Patentability and Written Opinion of the International Searching Authority, dated Jun. 29, 2010, of International Application No. PCT/US2008/014050, 9 pages.

* cited by examiner

*Primary Examiner* — Edgardo San Martin

(74) *Attorney, Agent, or Firm* — Hamilton, Brook, Smith & Reynolds, PC

(57) ABSTRACT

A region of air is manipulated to reflect, absorb, or redirect sound energy to prevent the sound energy from reaching a listener separated from the sound source by the region of air. The region of air may be manipulated by directing ultrasonic sound waves with a sound pressure level of at least 140 decibels at the region of air.

17 Claims, 9 Drawing Sheets

SOUND FIELD CONTROLLER

RELATED APPLICATIONS

This application is a continuation of International Application No. PCT/US2008/014050, filed Dec. 24, 2008 and which designated the United States, published in English, which claims the benefit of U.S. Provisional Application No. 61/026,355, filed Feb. 5, 2008; U.S. Provisional Application No. 61/025,183, filed on Jan. 31, 2008; and U.S. Provisional Application No. 61/009,495, filed on Dec. 28, 2007.

The entire teachings of the above applications are incorporated herein by reference.

BACKGROUND OF THE INVENTION

Currently, sound may be reduced or prevented from reaching a listener in one of two ways. First, a physical barrier, such as a wall, may be placed between the source of the sound and the listener. The wall will absorb some of the sound energy and reflect most of the rest of it. Second, sound waves at the listener's location may be negated by noise cancellation techniques. Noise cancellation relies on a separate audio source that creates a sound wave that is 180° out of phase with the sound to be canceled. However, unless the separate audio source is in exactly the same location and has the same characteristics as the sound source to be cancelled, the sound cancellation will only apply at specific points in space (nodes), not large regions. At other locations where sound waves from the sound source and cancelling source combine and form antinodes, the sound will be amplified.

SUMMARY OF THE INVENTION

Embodiments of the present invention manipulate properties of air in an air space, known as a barrier region, between a sound source and a listener to influence sound propagation in the barrier region. Nonlinearly-propagating ultrasound at high intensities may be used to alter sound energy propagation properties from normal air, typically including an apparent change of impedance.

When a sound wave hits the region of intense ultrasound and the change in propagation properties, some of the sound may be reflected from that region and the remainder may pass into the barrier region perhaps at a refracted angle. Moreover, the air space containing the intense ultrasound cannot always support the propagation of all of the additional sound energy. Instead, some or most of the additional sound energy is converted to heat energy, typically in a diabatic process. In some embodiments, at least 20% of the sound energy entering the barrier region is reflected away or converted to heat energy. In other embodiments, at least 90% of the sound energy entering the barrier region is reflected away or converted to heat energy. The result of the barrier region is that the sound waves from the sound source cannot reach the listener or reaches the listener at a greatly reduced volume.

Embodiments of the present invention may include a transducer and a signal driver, which provides driving signals to the transducer to generate an acoustic barrier region that influences sound propagation within the region. Embodiments of the present invention typically operate at frequencies between 20 kHz and 400 kHz and often in excess of 40 kHz. However, optimal frequencies may include those at which the amplifier electronically resonates and/or at which the transducer mechanically resonates (the design likewise, can be adapted to create electric and/or mechanical resonance at a desired frequency for efficient operation). Embodiments of the present invention typically operate at sound pressure levels in excess of 140 decibels and may extend to a range between 160 decibels and 200 decibels. Other frequency ranges and amplitude ranges can be utilized in various embodiments, though the ranges above are preferred in current implementation.

The transducer may include any one of an electrostatic transducer, a piezo-electric transducer, a PVDF transducer, a MEMS transducer, and a film transducer, or any other ultrasonic transducer capable of creating strong ultrasonic fields propagating in a nonlinear manner. Furthermore, the transducer may be an array of transducers arranged linearly, along a curve, or in any other arrangement to form a barrier region of a desired size, shape, and intensity. Additionally, the array may include several adjacent arrays, each array operating at a different phase, amplitude, or frequency to produce different barrier regions. Embodiments of the signal driver or amplifier include a digital switching or H-bridge amplifier as preferred, but linear or other amplifier designs may also be used.

In embodiments of the present invention, the signal generator may provide driving signals using a sine wave. Embodiments of the present invention may include a sensor to detect the presence of humans or other animals in proximity to the barrier region and either disrupt or diminish the barrier region.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1A:
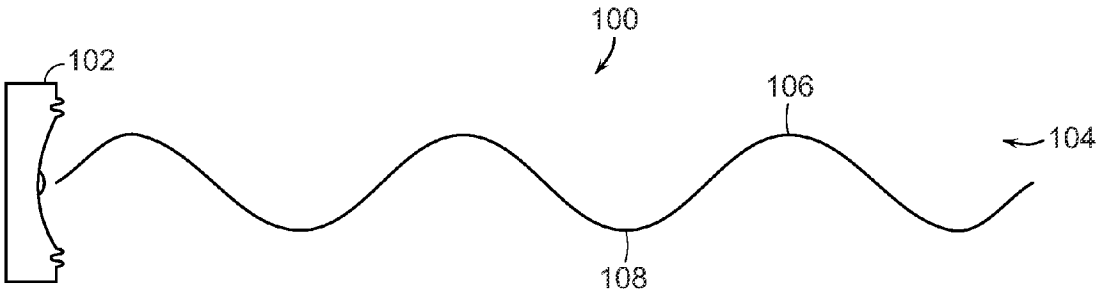
FIG. 1A shows a one-dimensional view of a sound wave propagating through a medium.

FIG. 1A illustrates the propagation of a sound wave 104 through air 100. The sound wave 104 emanates from a sound source 102, which is a speaker in this example. The sound wave 104 has alternating regions of high pressure (or high particle velocity), depicted as peaks 106 on the sound wave 104, and regions of low pressure (or low particle velocity), depicted as troughs 108 on the sound wave 104. FIG. 1A depicts sound wave 104 at an instant in time. As time advances, sound wave 104 and its alternating regions of high pressure 106 and regions of low pressure 108 move away from the sound source 102. It can be noted that sound waves can be described by either propagating pressure or particle velocity perturbations in the medium.

Figure 1B:
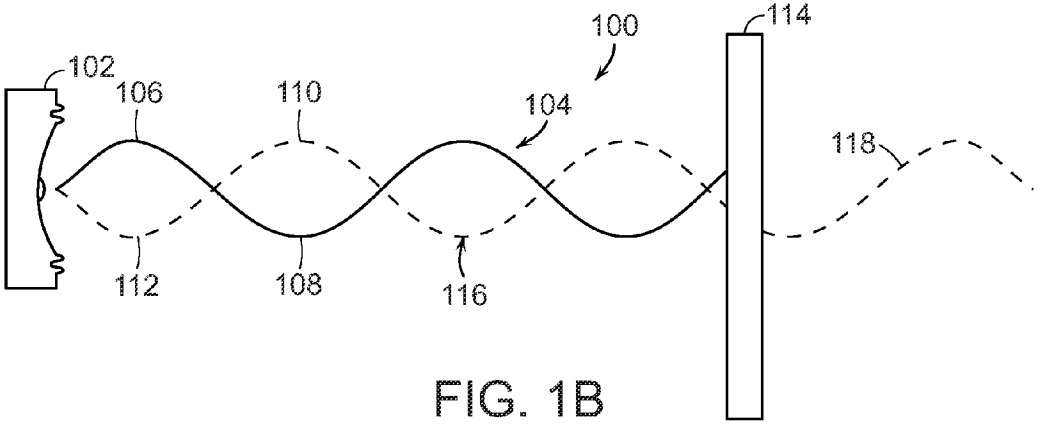
FIG. 1B shows a one-dimensional view of a sound wave propagating through a medium and reflecting and passing through a wall.

FIG. 1B illustrates the sound wave 104 interacting with a wall 114. When the sound wave 104 hits the wall 114, some of the sound energy enters the wall 114 and some of the sound energy is reflected. The amount of sound energy propagating through the wall, absorbed by the wall, and the amount reflected are dependent on the type of material from which the wall is made. For example, drywall will reflect most sound energy and only a small amount will be absorbed. In contrast, an acoustic foam panel by design only reflects a small amount of sound energy, a large amount of the sound energy entering the acoustic foam panel where it is mostly absorbed. The reflected sound wave 116 has lower sound energy (a lower sound pressure level) than the original sound wave 104. The reduced sound energy is illustrated by smaller peaks 110 and troughs 112. Of the sound energy entering the wall 114, some of the sound energy is converted within the wall to heat and the remainder is transmitted through the wall and continues to travel as sound wave 118 through the air 100. FIGS. 1A and 1B illustrate sound waves as being planar and one-dimensional for simplicity. Sound waves, in typical use, tend to spread and travel in all directions.

Figure 2A:
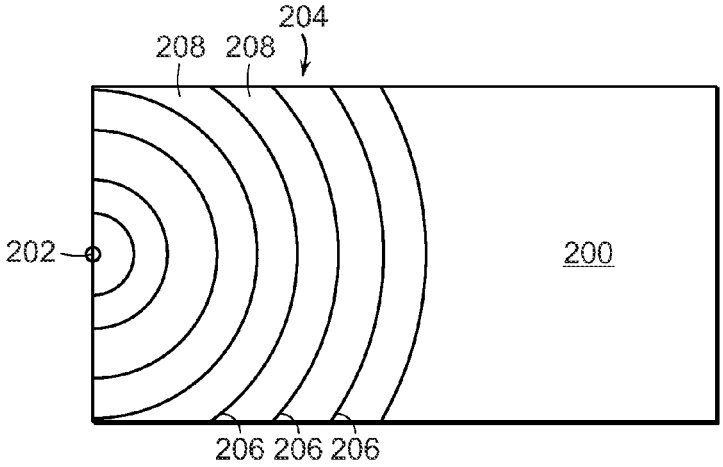
FIG. 2A shows a two-dimensional view of a sound wave propagating through a medium.
Figure 2B:
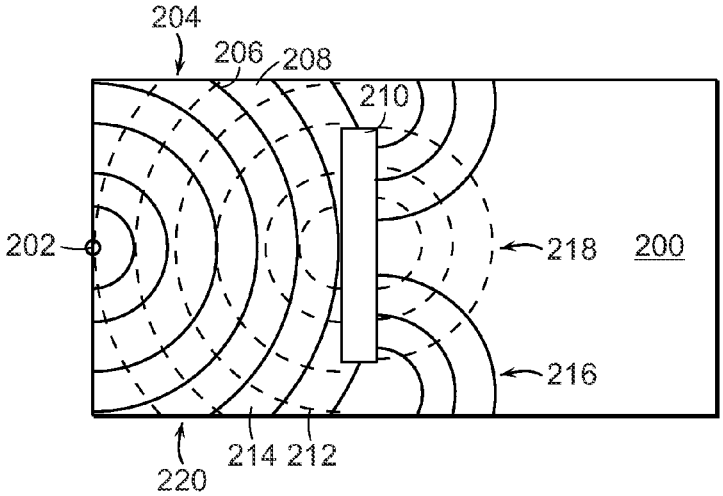
FIG. 2B shows a two-dimensional view of a sound wave propagating through a medium and reflecting and passing through and around a wall.
Figure 2C:
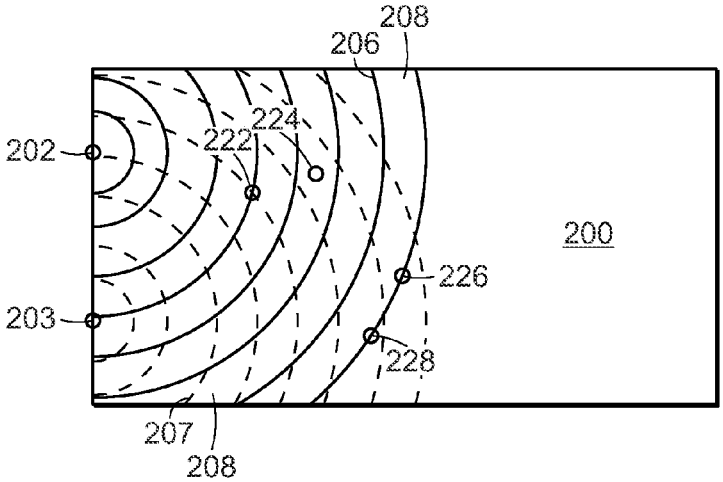
FIG. 2C shows a two-dimensional view of two sound waves interacting.

FIG. 2A illustrates a sound wave 204 propagating from a sound source 200 in two dimensions through an air space 200. Please note that FIGS. 2A through 2C are bounded are three sides by lines. These lines merely define the boundaries of each figure and do not represent surfaces with which the illustrated sound waves interact. The lines 206 of sound wave 204 represent the pressure peaks (106 in FIGS. 1A and 1B). The midpoint 208 between lines 206 of sound wave 204 represent the pressure troughs (108 in FIGS. 1A and 1B). The sound wave 204 is propagating away from sound source 202 in all directions, including the directions in and out of the page (not shown).

FIG. 2B illustrates the sound wave 204 interacting with a wall 210. Most of sound wave 204 is reflected off of wall 210, represented as wave 220 by dashed lines, having pressure peaks 212 and pressure troughs 214. A portion of sound wave 204 passes the edges of wall 210 and continues to propagate as sound wave 216. Finally, as discussed above, a portion of sound wave 204 is transmitted through wall 210 and continues to propagate as sound wave 218. Please note that sound waves in FIG. 2B are representative, and simplified to merely illustrate the foregoing concepts. Many factors which would affect the real sound wave propagations are ignored.

FIG. 2C illustrates the concept of sound cancellation. In this illustration, two sound sources 202, 203 are transmitting identical sound waves (i.e., identical wave length, phase, and strength). Solid lines 206 represent sound waves from source 202 and dashed lines 207 represent sound waves from source 203. Lines 206, 207 represent pressure peaks in respective sound waves and midpoints 208, 209 between lines 206, 207 represent pressure troughs in respective sound waves. Point 226 represents a physical point in the air space 200 where, at a given moment, a pressure peak 206 from sound source 202 is aligned with a pressure trough 209 from sound source 203. Because each sound source 202, 203 is producing waves of equal magnitude, pressure peak 206 is cancelled by pressure trough 209, and a listener at that exact point would hear no sound. By contrast, points 222 and 224 represent physical points in the air space where, at a given moment in time, both sound waves are at a pressure peak 222 or at a pressure trough 224, respectively. The result is that the sound energy of the two waves are added, resulting in an amplified sound for a listener at those locations.

Figure 2D:
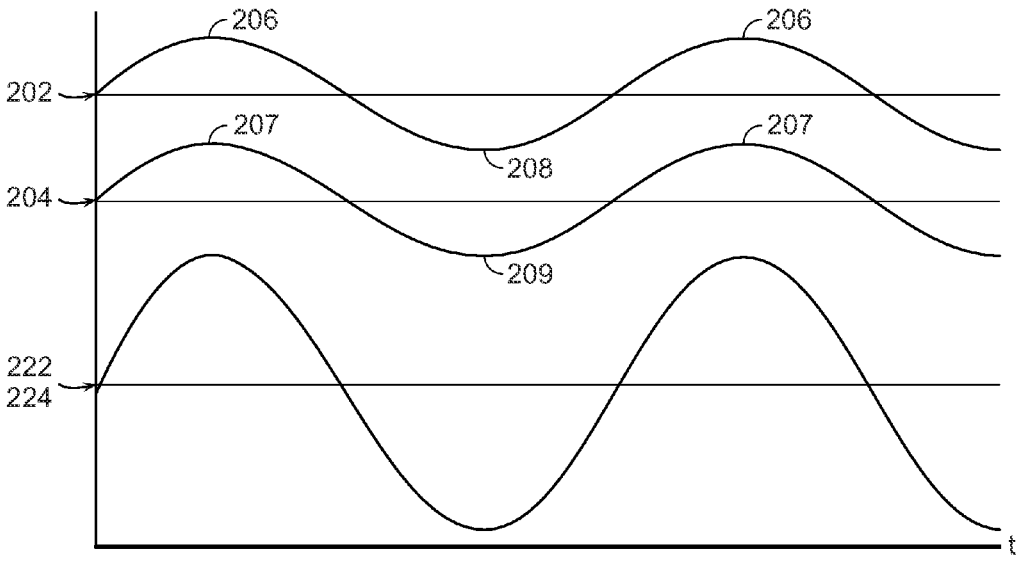
FIG. 2D shows a one-dimensional view of the sound waves of FIG. 2C constructively added at an anti-node.

FIG. 2D illustrates either point 222 or point 224 of FIG. 2C, or any other point in FIG. 2C where two sound waves are precisely in phase. FIG. 2D shows sound waves 202, 204 simultaneously reaching pressure peaks 206, 207 and pressure troughs 208, 209. The result at point 222 or point 224 is that the sound pressure level is doubled over the level of either individual wave.

Figure 2E:
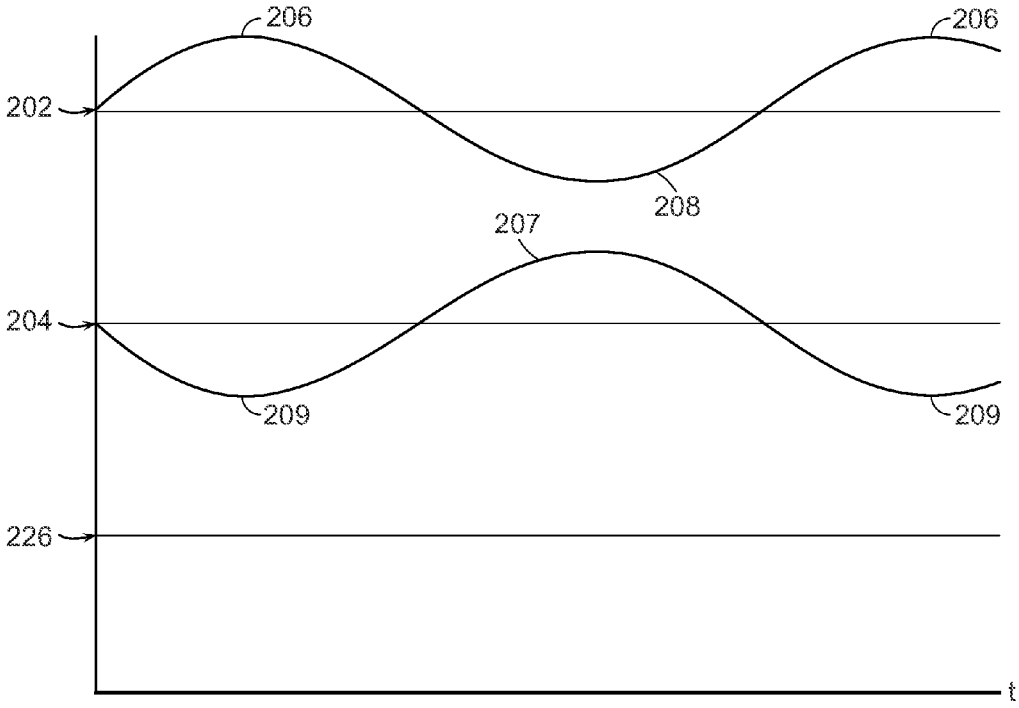
FIG. 2E shows a one-dimensional view of the sound waves of FIG. 2C destructively added at a node.

In contrast, FIG. 2E illustrates point 226 of FIG. 2C, or any other point in FIG. 2C where the two sound waves are 180° out of phase with each other. FIG. 2D shows sound wave 202 reaching a peak pressure 206 when sound wave 204 is reaching a pressure trough 209. Likewise, when sound wave 202 reaches a pressure trough 208, sound wave 204 reaches a pressure peak 207. The result is that the two sound waves 202, 204, at location 226, cancel each other out and the sound pressure level is zero at location 226 at all times.

At other locations, for example, point 228 in FIG. 2C, sound waves 202, 204 are out of phase by less than or more than 180°. A listener at these locations experiences a sound pressure level between zero and the doubled level.

Sound cancellation, as illustrated in FIG. 2C, can be used to cancel noise at specific locations. However, there are several limitations. First, as illustrated, the points of sound cancellation are generally very small; the maximum size of a region of sound cancellation is less than the wavelength of the sound waves. Consequently, as an example, a listener's right ear may be at a point of cancellation and the left ear may be close to a point of magnified sound. Second, cancelling noise at a listener's position requires perfect prediction of the undesired sound source, and the path of propagation of sound waves from the sound source. For example, suppose a listener is 5 meters away from the cancellation source. Sound waves traveling at 345 meters per second would require about 14 milliseconds to travel this distance. Therefore, noise cancellation will only be successful at the 5 meter range if the system can predict the precise acoustic signal at the listener's location 14 milliseconds in the future. This is highly unlikely, even in an ideal setting, except perhaps low-frequency, constant or repetitive tones. Additional factors, such as the varying shape and properties of the acoustic space, make implementation of noise cancellation much more complex. Complex physical shapes, materials, reflections, and any motion in the environment can completely confound the prospects of predicting the acoustic environment, even with substantial computational power, the acoustic scene would need to be perfectly measured, assessed, and modeled.

For the foregoing reasons, noise cancellation is limited to headphones and similar applications. In a headphone, only one point of cancellation is needed (not a region)—the eardrum (or ear canal). In addition, there is no notable propagation delay between the cancelling source and target point; they are all within the earphone cup. Microphones directly proximal to the ear canal entrance are used for direct feedback for cancellation. Finally, even in noise-cancelling headphones, sound cancellation is only attempted at very low frequencies (generally well under 1 kHz, typically under 400 Hz). Higher frequencies are blocked with conventional means (padding or occlusion).

Embodiments of the present invention use high intensity nonlinearly propagating ultrasonic sound waves to create a barrier region in an air space. The barrier region is essentially saturated acoustically by the ultrasound, and the local propagation properties are different than the surrounding air. The barrier region of intense ultrasound creates nonlinear propagation properties which inhibit additional (audible) sound waves from propagating through it. The barrier region of intense ultrasound also has altered sound propagation properties than the surrounding air, resulting in an apparent change in impedance, the apparent change in impedance causing sound waves to reflect and/or refract. Also, due to acoustic saturation, the barrier region may convert some amount of sound energy propagating through it to heat. The nonlinear ultrasound creating the barrier region will most likely have a frequency between 20 kHz and 400 kHz and sound pressure levels between 140 decibels and 200 decibels.

Figure 4:
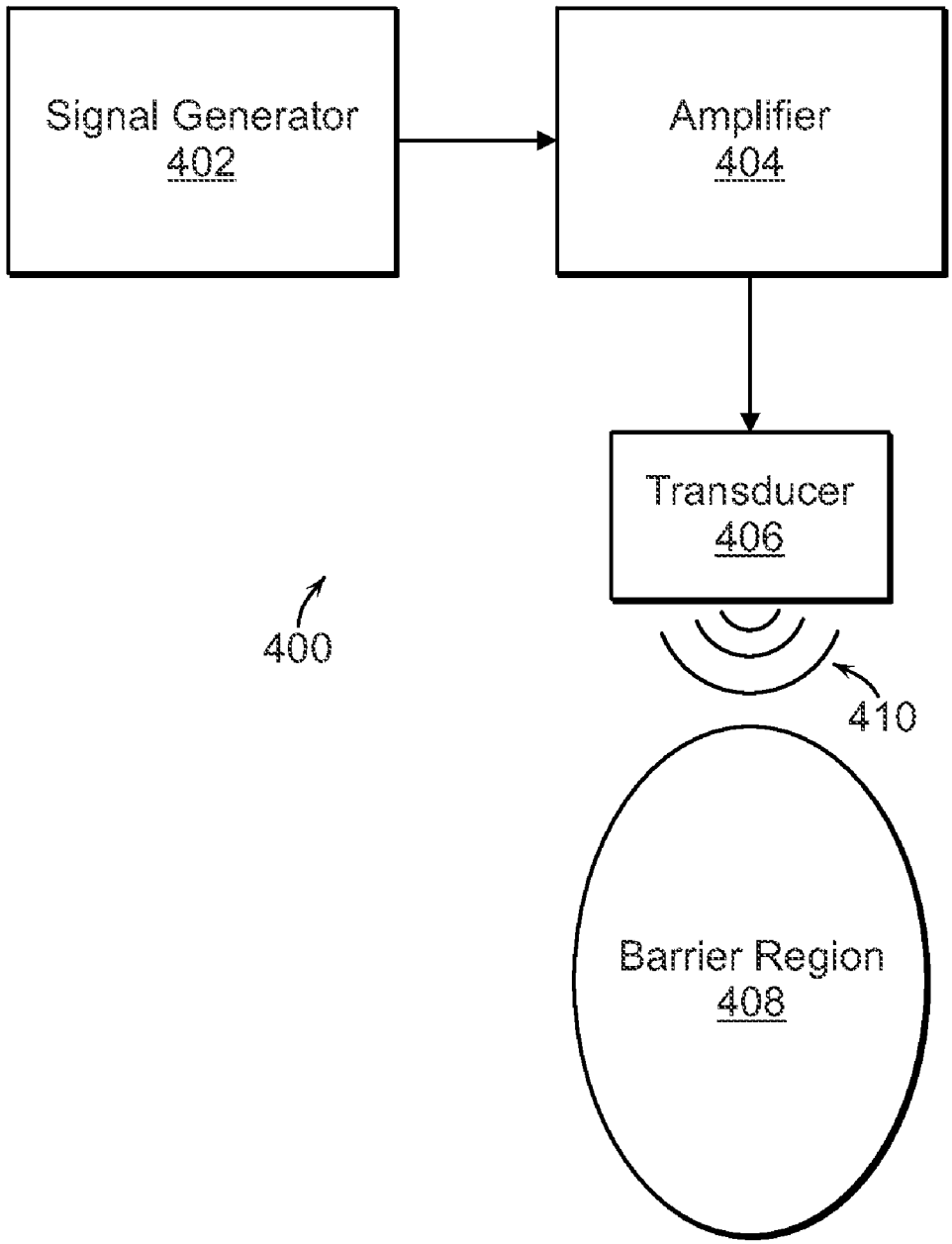
FIG. 4 shows an embodiment of the present invention.

FIG. 4 shows a possible system 400 for generating a barrier region 408 comprising three major components, a signal generator 402, an amplifier 404, and an acoustic transducer 406. The amplifier 404 may, for example, comprise either linear amplifiers or digital amplifiers. In most applications, digital switching amplifiers or H-bridge amplifiers are preferred because they weigh less and use less power than other types of amplifiers. The transducer 406 may be a film-based transducer, consisting of a patterned backplate with a conductive surface (or made from a conductive material) and a vibrating membrane with at least one conductive side. A voltage applied to the backplate and membrane causes electric forces to attract these surfaces together, creating vibration. The configuration of the film and geometry of the backplate pattern determines dynamic mechanical response (basically resonance and bandwidth), which can be optimized for various applications.

Typical types of alternative transducers 406 include, but are not limited to, piezo-electric transducers, electrostatic transducers, and polyvinylidene fluoride film (PVDF) transducers, Micro-Electro-Mechanical Systems (MEMS) transducers, and film transducers. Piezo-electric transducers have been used in some experiments, but may have limited application because, at high levels, they can usually only be used in short bursts rather than in a continuous fashion, due to heat damage. In typical applications, the burst period is less than one second. Piezo-electric transducers also tend to be very expensive and inefficient. Film-based transducers may be used continuously and have better bandwidth and power-handling capability than piezo-electric transducers. Examples of film-based transducers can be found in U.S. Pat. Nos. 6,771,785; 6,775,388; 6,914,991; 7,106,180; and 7,391,872.

Figure 5A:
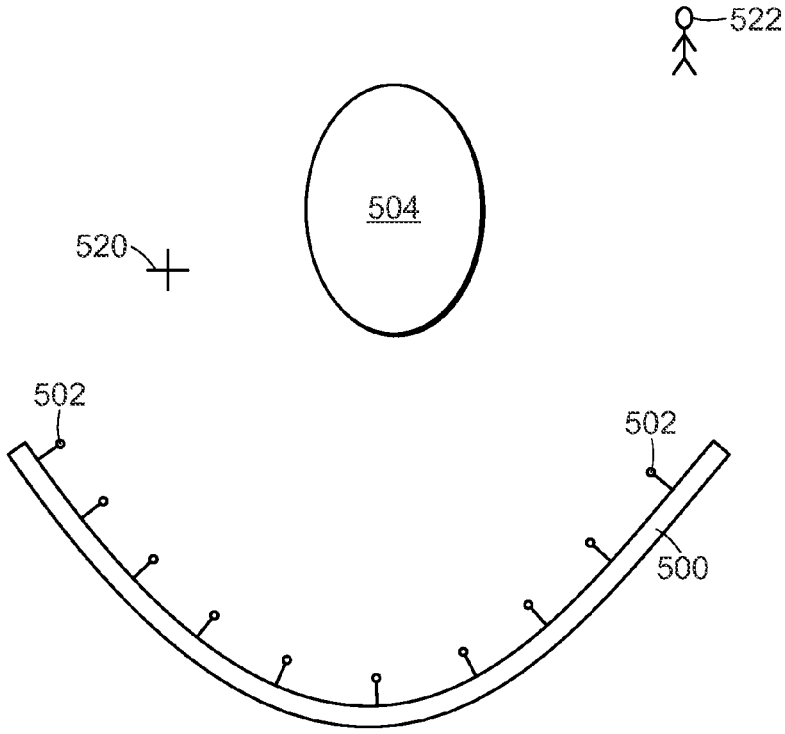
FIG. 5A shows an embodiment of the present invention with an array of transducers arranged on a curved support.

FIG. 5A shows an embodiment of the present invention in which transducers 502 are arrayed on a curved support 500. The ultrasonic sound waves produced by the transducers 502 are focused together in barrier region 504, thereby altering sound propagation properties within barrier region 504. A listener 522 on one side of the barrier region 504 will not be able to hear sounds emanating from source 520 because sound waves from source 520 will be partially reflected and possibly partially converted to heat by barrier region 504.

Figure 5B:
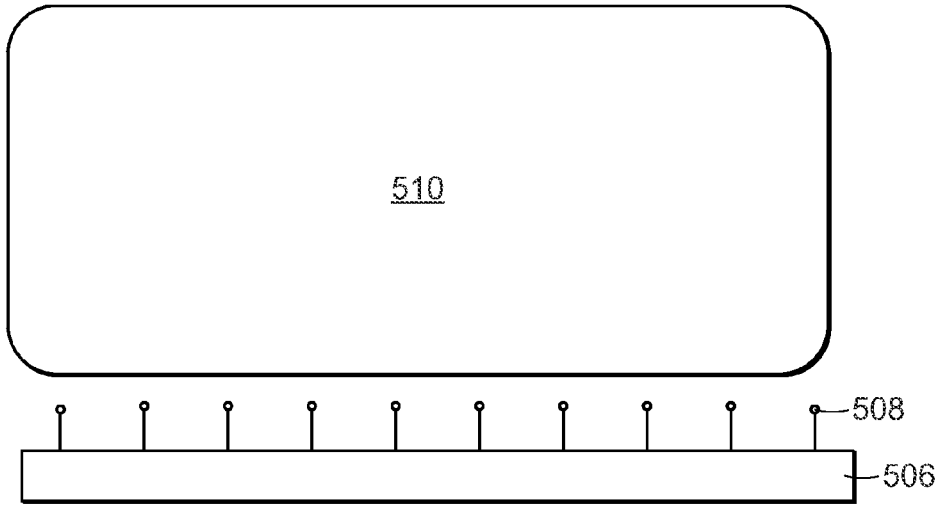
FIG. 5B shows an embodiment of the present invention with an array of transducers arranged on a linear support.

FIG. 5B shows another embodiment of the present invention in which transducers 508 are arrayed on a linear support 506. The high-intensity ultrasonic waves produced by the transducers 508 form a barrier region 510 above the transducers 508 that covers a larger area than barrier region 504 of the curved support 500. The linear array 506 results in less concentration of ultrasonic sound waves, so more powerful transducers may be required. Electrostatic transducers are most likely to achieve the required power and provide sufficient control at reduced cost. Also, driving the transducers and the electrical system powering the transducers at resonance frequencies may increase the sound pressure level produced by the transducers.

Figure 5C:
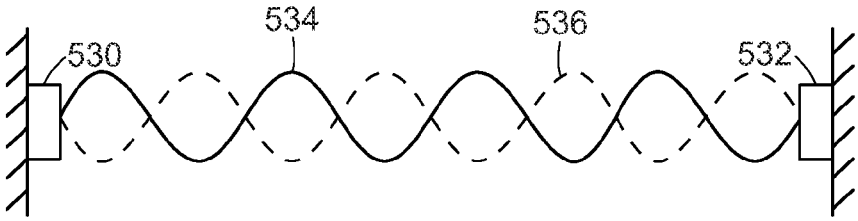
FIG. 5C shows an embodiment of the present invention in which transducers are set opposite one another to form a standing wave.

FIG. 5C shows an embodiment of the present invention in which two transducers 530, 532, or transducer arrays, oppose one another. The transducers are optionally spaced apart at a distance equal to an integer number of half-wavelengths of the sound waves being output by the transducers. As a result, a standing wave 534, 536 is established between the two transducers 530, 532. If the transducers 530, 532 are in phase with each other, the two standing waves 534, 536 will enhance each other, resulting in a higher intensity sound wave. Please note that waves 534, 536 are shown out of phase to clearly show the sound waves from each transducer 530, 532. Also, note that one transducer 530, 532 may be replaced by a reflective surface, which is either flat or curved, if needed.

Figure 5D:
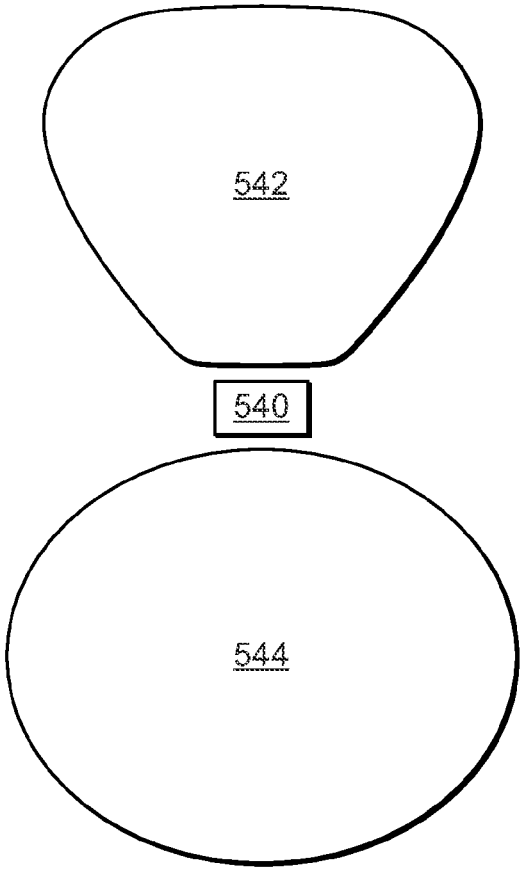
FIG. 5D shows an embodiment of the present invention in which a transducer or transducers form a fan-shaped barrier region.

FIG. 5D shows an embodiment of the present invention in which one transducer 540, or several transducers in close proximity, provide a field of barrier region 542 that fans out from the transducer 540. The transducer 540, or several transducers, may produce multiple barrier regions 542, 544. Generally speaking, sound waves exhibit less "fanning" or spreading as frequency increases. Therefore, creating a barrier region 542 with a "fanned" shape using ultrasonic frequencies, as shown in FIG. 5D, would likely require several transducers pointed in different directions or a transducer that emits sound energy in multiple directions.

A person having ordinary skill in the art would understand that the support member and/or transducer configuration may take many other shapes to create a barrier region of a certain shape.

It has been verified by experiment that a sufficient field of nonlinear ultrasound will form a barrier to audible sound traveling to a listener. The following explanations describe some of the theory behind forming such a barrier.

The models of sound depicted in FIGS. 1A-B and 2A-C assume that sound waves traveling through air exhibit purely linear behavior. A linear model of sound waves relies on two basic assumptions. First, sound waves traveling through the air do not change in frequency. Second, when two sound waves interfere, the interference at a point is merely the vector summation of waves at the point, but the waves do not influence each other. In other words, while constructive and destructive interference may exist, the sound waves pass through each other without being altered.

Nearly all common acoustic phenomena that are regularly experienced are adequately described by linear sound propagation. Conversations, telephones, loudspeakers, and most environmental noise are well approximated by linear sound propagation. This linear approximation is almost universal in common acoustics text books.

In some circumstances, however, acoustic waves do not behave in a perfectly linear fashion. As sound waves propagate, they distort and change shape to some small degree. Also, when two sound waves interfere, the two sound waves may influence each other and interact; the presence of an intense acoustic wave may alter the propagation characteristics of other waves. Most notably, the sound waves may change frequency because of the interaction. In calculations involving sound waves at commonly-encountered intensities, particularly those used by regular loudspeakers and most common sound sources, the non-linear effects are small and may be ignored. However, at sound pressure levels (volumes) between 120 and 140 decibels and higher, the nonlinear effects become significant. In current technology, the nonlinear effects become effective at blocking and absorbing sound waves starting at sound pressure levels of about 145 to 160 dB.

Figure 3A:
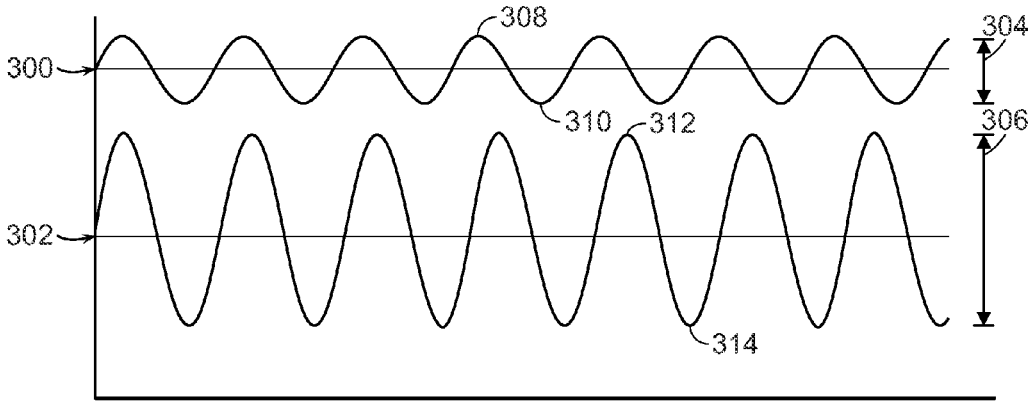
FIG. 3A shows a one-dimensional view of a low-intensity sound wave and a high-intensity sound wave.

FIG. 3A compares a sound wave having a low sound pressure level and a sound wave having a higher sound pressure level. Sound wave 300 has a low sound pressure level with a relatively small difference 304 between peak pressure 308 and minimum pressure 310. Sound wave 302 has a high sound pressure level with a relatively large difference 304 between peak pressure 312 and minimum pressure 314. As sound pressure levels increase, the difference between peak pressure and minimum pressure also increases.

Figure 3B:
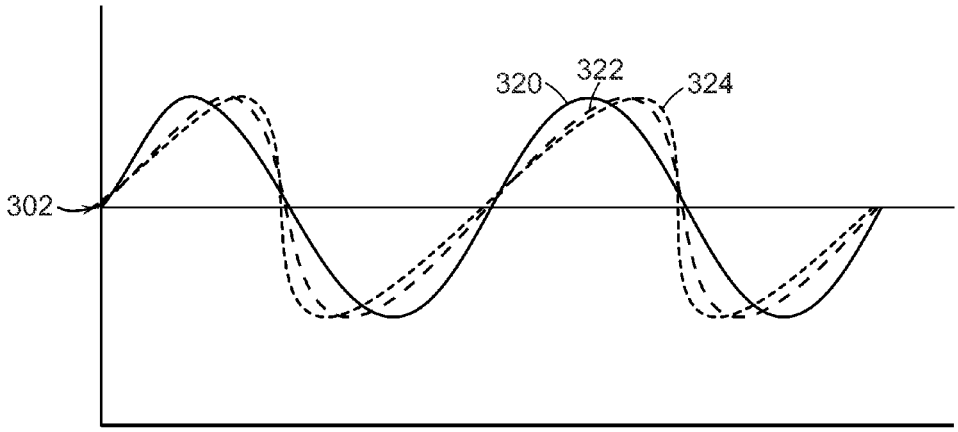
FIG. 3B shows a high intensity sound wave distorting and approaching a shock.

FIG. 3B illustrate an important nonlinear principle of sound waves. A sound wave 302 propagates at the speed of sound of the air, but in general terms, the speed of sound is roughly proportional to the particle velocity of the sound wave. As the sound wave travels, the peaks of the waves (in terms of particle velocity) begin to overtake the parts of the wave with low particle velocity. FIG. 3B shows a sound wave with a high sound intensity at three sequential locations. The sound wave at the first location 320 is close to the sound source and has no distortion. The sound wave at the second subsequent location 322 has distorted, causing the transition from the bottom of the wave to the top of the wave to become sharper. The sound wave at the third subsequent location 324 has distorted further. The transition from the bottom of the wave to the top of the wave at location 324 is almost instantaneous—essentially a shock.

The simplified distortion of a sound wave may be estimated by calculating the wave propagation speed, c, for an individual air particle within the sound wave according to the equation:

$$c = c_0 + \frac{1}{2}(\gamma - 1)u$$

where $c_0$ is the low amplitude speed of sound of the air, γ is the ratio of specific heats, and u is the particle velocity of individual air molecules within the sound wave. γ may be approximated to be a constant 1.4 for air. The above equation may be simplified by substituting $$\beta \text{ for } \frac{1}{2}(\gamma - 1).$$

Based on γ having a value of 1.4, β is typically a constant value of 0.2. Particle velocity, u, may be defined by the equation:

$$u = \frac{p}{Z}$$

where p is pressure and Z is acoustic impedance. Acoustic impedance may be further defined by the equation:

$$Z = \rho \cdot c$$

where ρ is the density of air. Substituting the equations for particle velocity and acoustic impedance into the equation for wave propagation velocity results in:

$$c = c_0 + \beta \cdot \frac{p}{\rho \cdot c}$$

which can be rearranged as:

$$c^2 - c_0 \cdot c - \beta \frac{p}{\rho} = 0.$$

The equation can be rearranged for c, resulting in:

$$c = \frac{1}{2}\left[c_0 \pm \sqrt{\left(c_0^2 - 4\beta \frac{p}{\rho}\right)}\right].$$

This equation can be simplified by assuming an air density, ρ, of 1.20 kg/m$^3$, which is the density of air at 20° C. for a standard atmosphere. Using this value of ρ, the grouping $$4\frac{\beta}{\rho}$$

may be simplified to:

$$4\frac{\beta}{\rho} = 4\frac{(0.2)}{(1.2)} = 0.6\overline{6}.$$

Consequently, the equation above, solving for c, may be simplified as:

$$c = \frac{1}{2}\left[c_0 \pm \sqrt{(c_0^2 - 0.6\overline{6}p)}\right].$$

Assuming the speed of sound to be 345 meters per second, than a sound pressure level of 2,000 pascals, equivalent to 160 dB, will result in a wave propagation speed of 339 meters per second, which is 98% of the speed of sound of air. A sound pressure level of 20,000 pascals, equivalent to 180 dB, will result in a wave propagation speed of 269 meters per second, which is 80% of the speed of sound of air. Finally, a sound pressure level of 30,000 pascals, equivalent to 183 dB, will result in a wave propagation speed of 172 meters per second, which is 50% of the speed of sound of air. By calculating the local speed of sound within parts of a sound wave, the distance the wave must travel before a shock develops, as well as shock properties, may be predicted. These calculations are simplified for the sake of understandability; the full process, particularly in 2D or 3D sound fields, is much more complex, and additional phenomena (relaxation, diffraction, etc.) also exist and would need to be included for a complete analysis.

As sound waves grow in intensity, the propagation of sound waves is no longer adiabatic; that is, sound wave energy converts directly to heat, and is unrecoverable. Additional sound wave energy added to these waves likewise is converted to heat through a diabatic process. The diabatic process naturally exists in properly constructed sound fields of sufficient amplitude and frequency. Limiting the frequencies to the ultrasonic band ensures that any systemic artifacts are not heard, and are absorbed quickly by the air (because absorption is approximately proportional to frequency squared). When a diabatic field is created with this method, additional incoming sound waves cannot be sustained, and at least some of the energy is converted to heat.

Also mentioned earlier, the near-shock formed in a barrier region causes a change in propagation properties from the surrounding air, similar to a change in impedance. When a sound wave encounters this region, a portion of the sound wave's energy will be reflected and the remainder will continue to propagate. The portion of the sound wave's energy that is reflected increases as the magnitude of the ultrasonic field increases.

Almost any sufficiently high-energy sound wave will approach a shock, though the shock forms more quickly at higher frequencies than at lower frequencies. However, higher frequency sound energy dissipates in air more quickly than lower-frequency sound energy. Therefore, choosing the ultrasonic frequency to create a barrier region will depend on the application, and requires a compromise. For example, if the sound source to be blocked is located close to the ultrasonic sound source, then a higher ultrasonic frequency may be used to form the shock as close to the ultrasonic source as possible. Alternatively, if the sound to be blocked is spread over a distance, than a lower ultrasonic frequency may be used to form as large a barrier region as possible. Typical ultrasonic frequencies used to form a barrier region are less than 200 kilohertz (kHz) and usually less than 100 kHz, primarily due to strong absorption as frequency increases.

Another consideration to be used in choosing an ultrasonic frequency is the fact that higher frequencies spread out less than lower frequency sound waves. Therefore, a sharper border between the barrier region and the surrounding air may be formed. The sharper border results in a sharper transition from the impedance of the surrounding air to the impedance of the barrier region. Consequently, it is believed that sound waves encountering a barrier region will reflect more strongly as the ultrasonic frequency used to form the barrier region increases.

Figure 7:
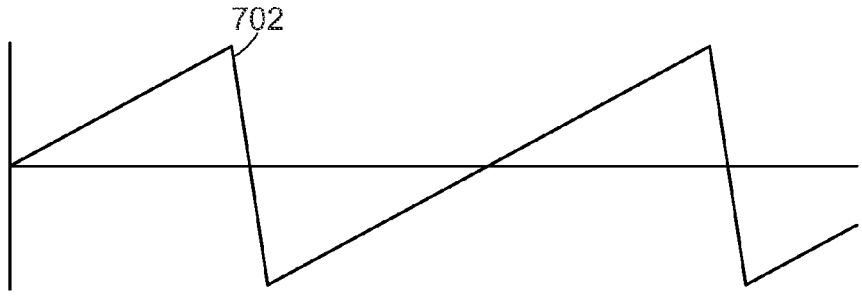
FIG. 7 shows a saw tooth sound waveform.

Also, the example sound wave in FIG. 3B is a sine wave. However, a person having ordinary skill in the art would understand that other wave forms besides sine waves may be used for different effects and system optimization. For example, a saw tooth wave form may be used and may form a shock faster than a sine wave form because the saw tooth wave form, such as the saw tooth wave form 702 shown in FIG. 7, leaves the transducer with an abrupt transition from high particle velocity to low particle velocity.

Based on the theory explained above, additional embodiments, described below, may be advantageous.

Figure 6B:
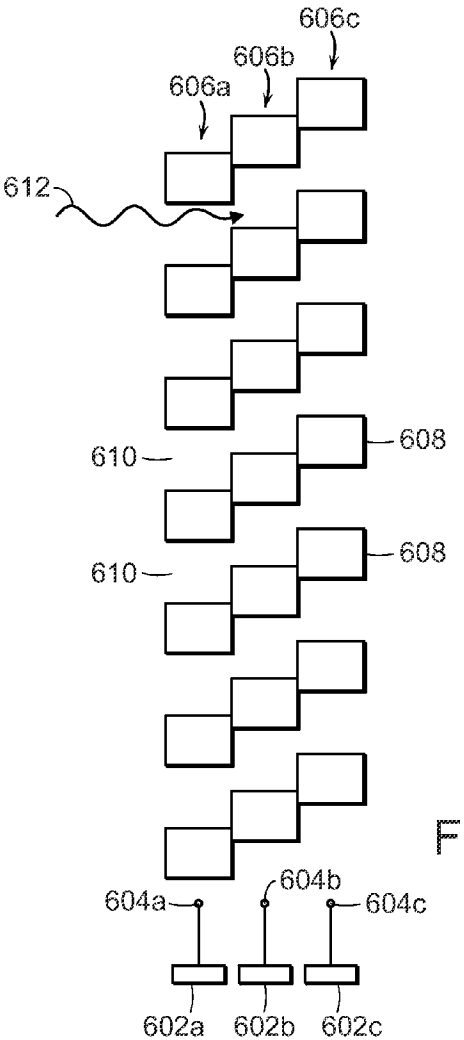
FIG. 6B shows the embodiment of FIG. 6A in which each array operates at a different phase.
Figure 6A:
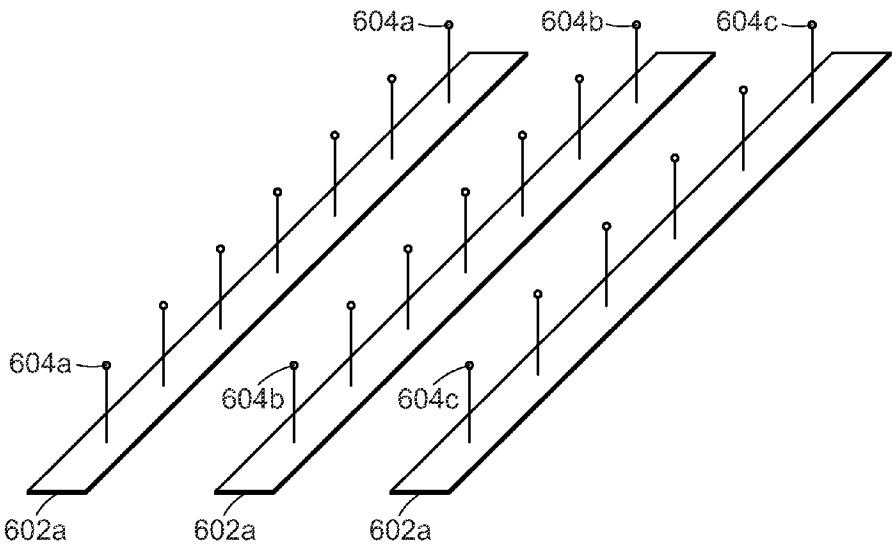
FIG. 6A shows an embodiment of the present invention with several adjacent arrays of transducers.

It is believed that the ultrasound field may only be effective at reflecting and/or absorbing sound energy at the part of each sound wave approaching a shock, creating gaps through which sound waves may propagate. FIG. 6A provides a solution to this problem by lining up several arrays 602*a-c* of transducers 604*a-c*. The transducers of any given array 602*a-c* operate with the same phase. Each array, however, operates at a different phase from other arrays. FIG. 6B shows the three arrays 602*a-c* and respective transducers 604*a-c* wherein each array is producing an ultrasonic sound field 606*a-c* generating regions of shock. Each shock region 608 is a region that blocks sound. Any individual ultrasonic sound field 606*a-c* has regions not containing shock 610 through which sound waves 612 may pass. For example, if only ultrasonic field 606*a* in FIG. 6B were present, sound wave 612 would be able to slip through region 610 not containing a shock. However, by stacking the ultrasonic sound fields 606*a-c* and operating each array 602*a-c* of transducers 604*a-c* at a different phase, the regions not containing a shock 610 overlap with shock regions 608, thereby preventing sound waves from propagating through the ultrasound fields 606*a-c*. The actual number of arrays needed may vary based on the particular frequency of the ultrasonic waves being used.

Figure 6C:
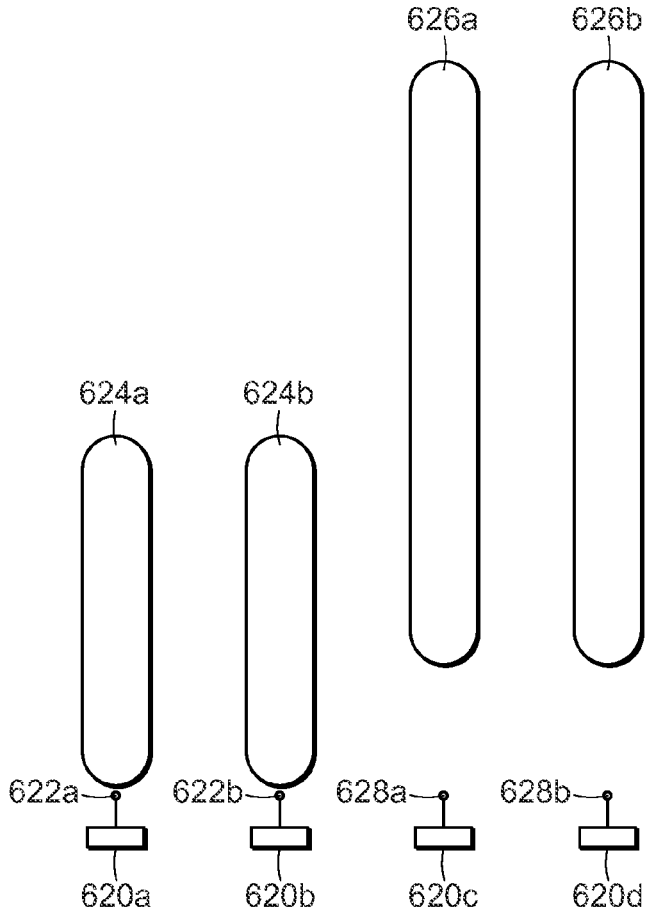
FIG. 6C shows the embodiment of FIG. 6A in which each array operates at a different frequency and a different phase.

FIG. 6C shows an embodiment of the present invention in which multiple arrays are arranged in line similarly to FIG. 6B. However, at least one of the arrays operates at different frequencies from other arrays. Recall that as frequency decreases, the distance required to form a barrier region increases, but the distance over which the barrier region is sustained also increases. By providing multiple arrays of transducers operating at different frequencies, it is believed that barrier regions may be stacked to cover a larger area than a single transducer (or transducer array) may be able to cover using a single frequency. In the embodiment shown in FIG. 6C, there are four arrays 620*a-d* of transducers 622*a-b*, 628*a-b*. Transducers 622*a-b* operate at a first frequency and transducers 628*a-b* operate at a second frequency lower than the first frequency. Consequently, transducers 622*a-b* produce barrier regions 624*a-b* that form closer to their respective transducers 622*a-b* than barrier regions 626*a-b* to their respective transducers 628*a-b*. However, barrier regions 626*a-b* extend further from their respective transducers 628*a-b* than barrier regions 624*a-b* extend from their respective transducers 622*a-b*. By stacking barrier regions 624*a-b* and 626*c-d*, an overall barrier region is formed with a larger effective area than any single array could form. Although transducers 622*a* and 622*b* operate at the same frequency, each may operate at a different phase to avoid gaps as described above in FIG. 6B. Likewise, transducers 622*c* and 622*d* may operate at different phases. Four transducer arrays are described in FIG. 6C. A person having ordinary skill in the art would understand that more or fewer arrays could be used to suit a particular application. Additionally, all transducers may be arranged on a single array with individual transducers providing different frequencies. Further, this example describes arrays of transducers. However, single transducers producing a fan-shaped barrier region, such as that illustrated by FIG. 5D, may be used instead.

It is believed that distorting a sound wave to prevent it from reaching a listener may also be accomplished by setting up a standing wave (or traveling wave), described in FIG. 5C, that changes local pressure enough to create an acoustic "diffraction grating", which will impact the acoustic wave traveling through it. If necessary, several diffraction gratings can be used next to each other (slightly out of phase) to "bend" the propagation path of sound.

Changes to the properties of the air within the barrier region by other means may affect the absorbing and refracting capabilities of the barrier region. For example, changing the gas in the barrier region or at least a boundary of the barrier region may enhance the change in propagation properties, thereby increasing the amount of sound energy reflected off the surfaces. A gas change may simply include adding humidity, ions, or other chemical agents to the air. As a further example, changing the air temperature within the barrier region may have the same effect. As another example, causing air molecules to relax to a lower energy state, which may occur through a chemical reaction, can give rise to acoustic absorption, thereby decreasing the propagation of a sound wave. Properties of air may be used to control various parameters of the system, such as frequency choice, source waveform, and/or output levels.

Although not required by the present invention, microphones may be set up near the barrier region to detect any residual sound and close-by speakers or transducers may provide an out-of-phase signal to at least partially cancel the sound. Similarly, the incoming acoustic signal may be used to alter or adjust the ultrasonic field to better conserve power or energy, or to optimize the characteristics of ultrasound to best limit the incoming sound wave. The system can also be adapted to discriminate between desirable and undesirable sounds, for example, allowing speech to pass, but not noise.

In the event that potentially dangerous levels of ultrasound (or other energy) are used, an automatic shutoff (or level control) system can be employed to reduce energy, should a user become otherwise exposed to high levels of energy. The detection of a user (or any undesirable object, such as a pet) within the field is probably easiest via infrared, but can be implemented with ultrasound or other methods as well.

Many applications for such a barrier region exist. The following applications are provided as example only and do not limit the scope of applications for which a barrier region may be used. A barrier region may be used to sonically isolate a room within a building. A barrier region may also be used to sonically isolate one building from another or from a noise source. A barrier region may also be attached to a moving object, such as a vehicle, aircraft, or person, to block noise caused by movement of the object. The barrier can be used to reduce the amount of sound from any undesirable source reaching a listener, or separate region, much like physical barrier walls are currently used. The principles described above would apply to other media besides air, including water environments.

While this invention has been particularly shown and described with references to example embodiments thereof, it will be understood by those skilled in the art that various changes in form and details may be made therein without departing from the scope of the invention encompassed by the appended claims.

What is claimed is:

1. A method of influencing propagation of sound from a sound source through a region comprising:

forming a barrier region in air between the sound source and a listener, including generating non-linear ultrasound with sound pressure of at least 140 decibels and directing the non-linear ultrasound at the region, an acoustic transducer driven at an ultrasound frequency at which the acoustic transducer mechanically resonates, the non-linear ultrasound resulting in at least one of:

(i) different acoustic impedance within the region compared to outside of the region; and (ii) acoustic saturation of at least a portion of the region.

2. The method of claim 1 wherein the emitted non-linear ultrasound has frequencies are in a range between 20 kilohertz and 400 kilohertz.

3. The method of claim 1 wherein the emitted non-linear ultrasound has a waveform selected from the group consisting of: an approximated sawtooth waveform, and an approximated sinusoidal waveform.

4. The method of claim 1 further comprising detecting the presence of an animal in proximity to the region; and ceasing or reducing the emitting of non-linear ultrasound into in the region.

5. An apparatus for generating a barrier region in air, comprising:

an acoustic transducer adapted for generation of ultrasonic waves with sound pressure level of at least 140 decibels; and a signal driver adapted for providing a driving signal to the acoustic transducer to generate non-linear ultrasound in a region, the non-linear ultrasound resulting in at least one of:

(i) a different acoustic impedance within the region compared to outside of the region; and (ii) acoustic saturation of at least a portion of the region;

wherein the acoustic transducer is driven at an ultrasonic frequency at which the acoustic transducer mechanically resonates.

6. The apparatus of claim 5 wherein the acoustic transducer is selected from the group consisting of: a piezo-electric transducer, a PVDF transducer, a MEMS transducer, an electrostatic transducer, and a film transducer.

7. The apparatus of claim 5 wherein the acoustic transducer includes an array of acoustic transducers.

8. The apparatus of claim 7 wherein the array of acoustic transducers are arranged along a curve.

9. The apparatus of claim 7 wherein the array of acoustic transducers are linearly arranged.

10. The apparatus of claim 7 wherein the array of acoustic transducers is a two-dimensional array.

11. The apparatus of claim 10 wherein adjacent arrays of acoustic transducers produce ultrasonic signals at different phases.

12. The apparatus of claim 7 wherein at least one transducer of the array produces ultrasonic signals at a different phase with respect to at least one of remaining transducers.

13. The apparatus of claim 5 wherein the signal driver comprises an amplifier that is driven at an ultrasonic frequency at which an electrical circuit that includes the amplifier and transducer electronically resonates.

14. The apparatus of claim 5 wherein the driving signal is selected from the group consisting of: an approximated sawtooth wave, and an approximated a sinusoidal wave.

15. The apparatus of claim 5, wherein the driving signal has a frequency in a range between 20 kilohertz and 400 kilohertz.

16. The apparatus of claim 5 further comprising a sensor configured to detect the presence of an animal in proximity to the barrier region in air and to deactivate or to reduce the intensity of the driving signal in response to detection of the presence of the animal in proximity to the barrier region.

17. A method of influencing propagation of sound through a region comprising:

emitting non-linear ultrasound generated at sound pressure levels of at least 140 decibels into the region, the non-linear ultrasound resulting in at least one of:

(i) reflecting the sound;

(ii) refracting the sound; and (iii) converting the sound energy to heat energy.

* * * * *